United States Patent [19]

Sonnenberg

[11] 3,964,744

[45] June 22, 1976

[54] BOWLING PIN AND BALL SORTING APPARATUS

[76] Inventor: Darwin D. Sonnenberg, Rte. No. 1, Hamler, Ohio 43524

[22] Filed: July 7, 1975

[21] Appl. No.: 593,657

[52] U.S. Cl. ..... 273/43 E; 273/49
[51] Int. Cl.[2] ..... A63D 5/02
[58] Field of Search ..... 273/49, 43 R, 43 A, 273/43 E

[56] References Cited

UNITED STATES PATENTS

| | | | |
|---|---|---|---|
| 3,456,946 | 7/1969 | Buck | 273/49 |
| 3,560,129 | 2/1971 | Diaz | 273/49 |
| 3,822,882 | 7/1974 | Easterly | 273/49 |

*Primary Examiner*—Anton O. Oechsle
*Attorney, Agent, or Firm*—William P. Hickey

[57] ABSTRACT

An automatic pin setting machine having a striker which periodically passes through the flow path of the pins and ball on the way to their elevating wheels and which removes the ball from the flow path without interrupting the flow of pins. The striker preferably moves downwardly and rearwardly as it approaches the position where it normally engages the ball and then moves upwardly and forwardly. The striker is also preferably driven in timed relation to the pin elevating mechanism. In the embodiment shown and described, the striker rotates about a stub shaft having a longitudinally centerline which extends forwardly and downwardly at an angle to the centerline of the ball elevating wheel.

7 Claims, 4 Drawing Figures

BOWLING PIN AND BALL SORTING APPARATUS

BACKGROUND OF THE INVENTION

As any bowler knows, the resulting action of a spherical bowling ball on irregularly shaped bowling pins is not easily predicted when the pins are vertically and uniformly spaced; and the results which occur when the pins are horizontal and randomly oriented is even harder to predict. Automatic pin setting apparatus for removing the disarrayed bowling pins and bowling ball from a lane must sort the ball from the pins and convey the bowling ball to a return runway, and the pins to an elevated storage rack where at the appropriate time they can again be lowered on the alley in a predetermined position. After the pins are knocked down by a bowling ball in disarray, they must take a common path through the apparatus which separates the bowling ball from the pins before the bowling ball and the pins reach a point in their travel where they engage the apparatus which is designed specifically to handle and transport the ball on one hand, and the pins on all other. The problem of separating a ball from the pins and starting the ball in the equipment that is specifically designed to carry the ball, must not interfere with the travel of the pins on their way to the materially handling equipment that is specifically designed to handle the pins. The result has been that the machines which have been developed by the prior art thus far, work imperfectly in the area where the ball and pins are separated from their common path of travel, particularly when more than normal amounts of oil or wax are applied to the bowling lanes, or the equipment. Bowling balls sometimes remain in the common path of the pins and ball through the equipment, until such time as an operator forces the ball out of the common path into the equipment which is specifically designed to handle the ball. Usually an operator is nowhere near the particular lane where the difficulty has occurred, and bowling must be discontinued until such time as the operator is located and sent to the particular lane where the difficulty exists.

An object of the present invention is the provision of automatic pin-setting and ball-return apparatus which separates the ball from the pins regardless of the amount of oil or wax which has accumulated on either the ball or ball wheel.

Another object of the invention is to provide improved principles and apparatus which can be adapted to elements of existing apparatus to improve the reliability of the existing apparatus.

Further objects and advantages of the present invention will become apparent to those skilled in the art to which the invention relates, from the following embodiments described with reference to the accompanying drawings forming a part of this specification.

DESCRIPTION OF THE PREFERRED EMBODIMENTS

Figure 1:
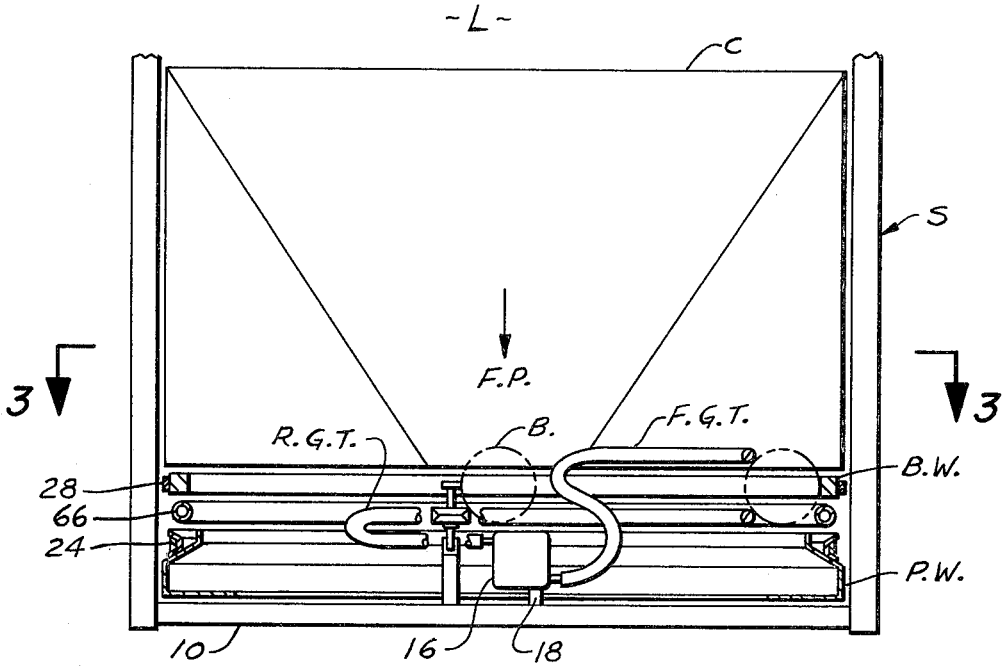
FIG. 1 is a somewhat schematic plan view in section taken generally on the centerline of ball and pin elevating elements of an automatic pin setter embodying principles of the present invention.

The automatic bowling pin and ball sorting and elevating apparatus shown in the drawings, and which are a necessary part of an "automatic pin setter" generally comprises:

a support structure S having a rear vertical stanchion 10, a pin elevating wheel PW forwardly of the rear stanchion 10, a ball elevating wheel BW forwardly of the pin wheel PW, and a conveyor C forwardly of the ball wheel BW for conveying bowling pins and balls from the lane L to the ball wheel and the pin wheel. The conveyor C gathers the knocked down pins and the bowling ball from the alley and converges them into a common flow path which extends over the bottom of the ball and pin wheels. In the embodiment shown in the drawings, the conveyor C is a vibratory deck whose rear corners are turned slightly upwardly to converge the pins and ball into the central flow path proceeding to the elevating wheels. The pin wheel PW comprises an annular frame having suitable pockets therein, not shown in detail, for receiving the pins from the flow path and elevating them upwardly into a pin conveyor PC, best seen in FIG. 3, which carries the pin forwardly to a pin storage rack, not shown, that is positioned over the lane L and which is lowered into the alley for resetting of the pins. A pin retaining ring, not shown, is positioned inwardly of the pin wheel PW for holding the pin in the pin wheel until such time as they reach the pin chute 12 which extends downwardly to the pin conveyor PC. The chute 12 is arranged so that the heavy end of the pin falls downwardly onto the pin conveyor PC to thereby allign the pin's bottom end first onto the pin conveyor. The pin conveyor PC then elevates the pins into the storage rack, not shown, which holds the pins properly spaced above the alley for lowering onto the alley at the appropriate time.

Figure 2:
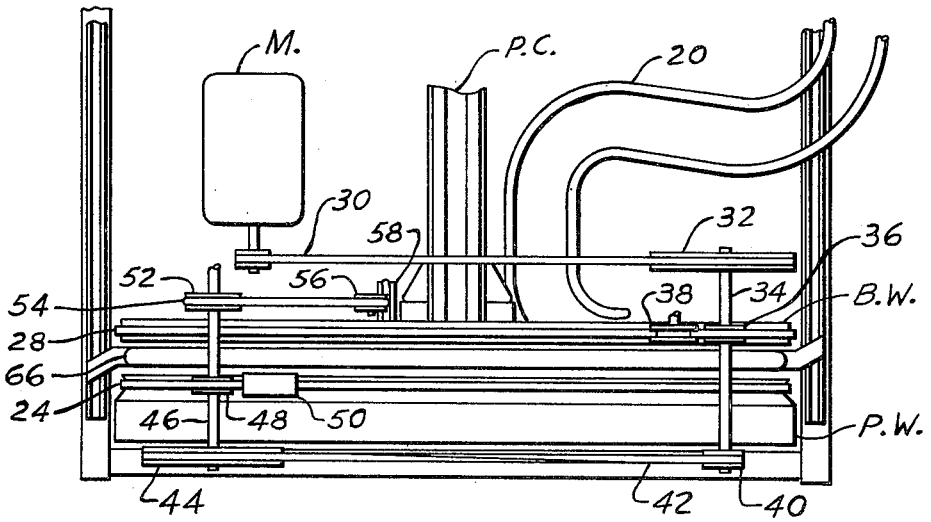
FIG. 2 is a schematic plan view taken at an elevation above FIG. 1 and showing the drive mechanism for the elements seen in FIG. 1.
Figure 4:
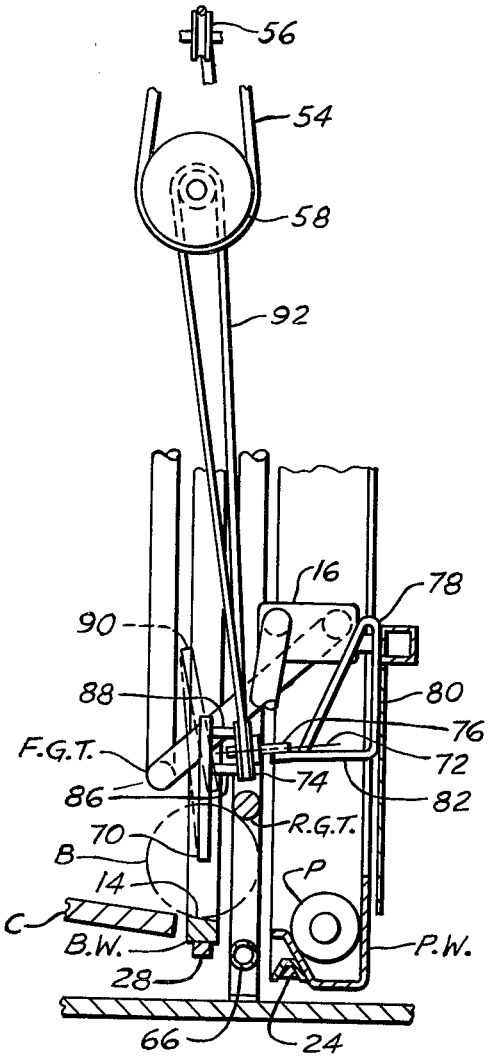
FIG. 4 is a fragmentary sectional view taken approximately on the line 4—4 of FIG. 3.

The ball wheel BW comprises an annular ring having an internal friction surface 14. The friction surface 14 is in line with the top surface of the conveyor C, as best seen in FIG. 4, such that the pins must pass over the ball wheel BW in order to get to the pin wheel PW. The ball is prevented from passing through the ball wheel BW by reason of a rear guide track RGT which has a section that extends over the flow path and is curved upwardly to a pivoted weight 16. The weight 16 is pivoted about the shaft 18 to normally hold the entry portion of the rear guide track downwardly into a ball intercepting position which prevents the ball from passing on through to the pin wheel PW. A front guide track FGT is provided forwardly of the ball wheel BW and it has a curved entry portion that extends upwardly short of the flow path and which is fastened to the opposite pivoted end of the weight 16. Suitable stops, not shown, are positioned for holding the weight 16 at such a position as to provide an interference bit between a ball and the leading edge of the front guide track FGT so that friction from the ball wheel inner surface 14 must drive the ball circumferentially of the wheel and wedge up the entry portion of the front guide track. Once the ball is wedged between the front and rear guide track and the friction surface 14, the ball rolls around the guide tracks and the friction surface 14 until the ball reaches a position above the ball return chute 20. The ball chute 20 provides a curved track leading to the elevated ball return along the side of the alley. FIG. 1 is taken on a line generally below the pin conveyor and ball return chute 20 to better show the common flow path and the entry of the ball and pins to their elevating wheels. FIG. 2 is taken above the pin conveyor PC and ball return chute 20 and shows the drive structure for the elevating wheels.

Figure 3:
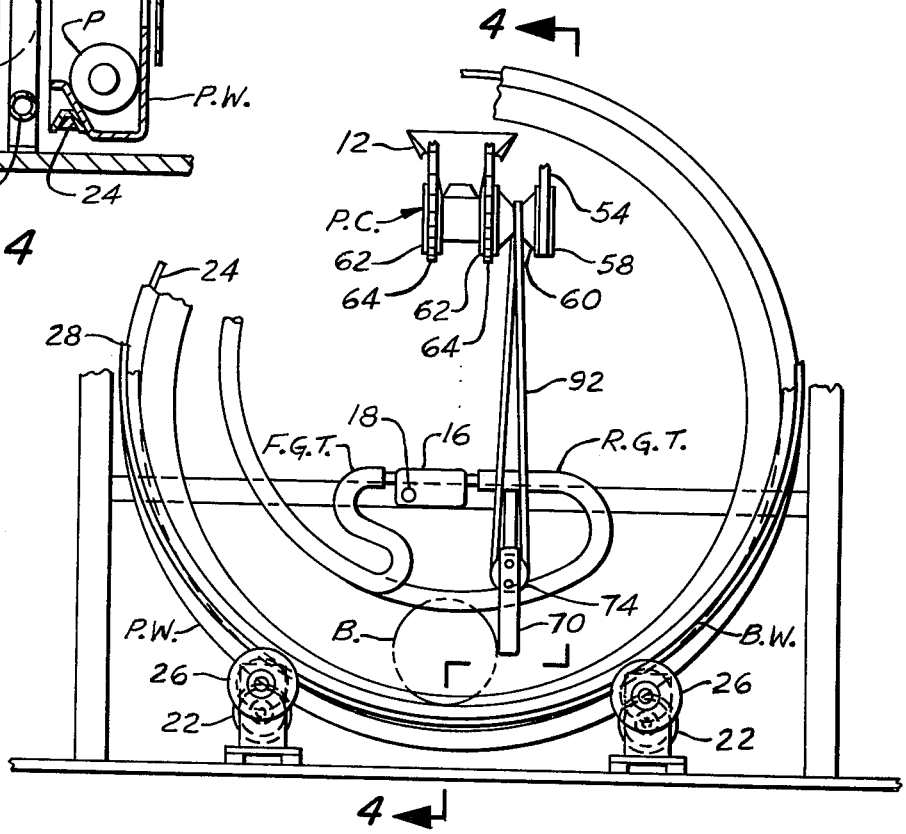
FIG. 3 is a fragmentary vertical sectional view taken approximately on the line 3—3 of FIG. 1.

The pin wheel PW is supported on a pair of spaced apart rollers 22 as best seen in FIG. 3, and is driven by a belt 24, which extends around the periphery of the wheel to overhead drive shafting as will later be explained. The ball wheel BW is positioned at a higher elevation than the pin wheel by a pair of rollers 26, and the ball wheel is driven by a belt 28 which extends around the periphery of the ball wheel to drive shaft structure positioned above as will later be explained.

The elements of the pin setting apparatus are driven in timed relation by a single motor M that is positioned above the wheels and to one side of the longitudinal centerline of the apparatus. A drive belt 30 extends from the motor M over a pulley 32 affixed to the right jack shaft 34 which jack shaft contains the drive pulley 36 for driving the belt 28 of the ball wheel BW. A suitable idler 38 is provided for regulating the tension of the drive belt 28. The right jack shaft 34 extends rearwardly to a transfer pulley 40 which drives a belt 42 which extends over the drive pulley 44 of the left jack shaft 46. The left jack shaft 46 contains the drive pulley 48 for the belt 24 of the pin wheel PW. The belt 24 passes under a drive pulley 48 and then up over an idler 50 to cause the pin wheel to rotate clockwise as seen from the rear of the machine. The ball wheel on the otherhand moves counterclockwise as seen from the rear of the machine. The left jack shaft 46 also contains a drive pulley 52 for a belt 54 that extends over an idler 56 and then downwardly over a drive pulley 58 that is connected to a hub 60 of the pin conveyor PC. The hub 60 is best seen in FIG. 3 and carries a pair of spaced apart conveyor pulleys 62 each of which receives a narrow conveyor belt 64. The conveyor belts 64 carry the pins from the chute 12 to the storage rack, as previously described. As previously explained, the bottom of the pin wheel PW is at a lower elevation than is the ball wheel BW, and a filler ring 66 is provided, as best seen in FIGS. 2 and 4, between the two wheels to prevent the pins from becoming wedged therebetween.

In order that the present invention can best be understood, a description of the operation of the mechanism so far described will first be given. Pins that are knocked in disarray are received from the lane by the conveyor C which then converges the pins into a common flow path which extends over the bottom of the ball wheel into the pin elevating wheel PW. The ball wheel rotates clockwise as seen in FIG. 3, and the pin wheel rotates counterclockwise as seen in FIG. 3. Because the ball wheel and pin wheel rotate in opposite directions, the pins will tend to be rotated 90° so that their axes extend generally circumferentially of the pin wheel, whereupon they drop into one of the pockets of the pin wheel and are elevated to the top of the wheel. A ball being carried along with the pins will engage the generally horizontal portion of the rear guide track RGT as best seen in FIG. 3 to cause the ball to rest upon the friction surface 14 of the ball elevating wheel BW. To the extent of the friction developed between the ball wheel and the ball, the ball will start to rotate and be carried along the rear guide track into engagement with the leading edge of the front guide track FGT. Friction between the front guide track and the rotating ball will cause the front guide track to rise with the ball rolling underneath. Thereafter the front and rear guide tracks hold the ball centered on the ball elevating wheel BW. Friction between the ball and the front and rear guide tracks causes the ball to roll therealong as the friction between the ball and the ball elevating wheel provides the rolling action. The ball, therefore, rolls along the guide tracks until it is at a point adjacent the top third of the ball wheel, whereupon it rolls out over the upper ends of the guide track onto the ball return chute 20 which starts the ball on its way to the ball return along the side of the alley.

The pins that are received in the pin wheel PW are carried upwardly until they are adjacent the top of the pin wheel, at which point the hold-down guide track, not shown, terminates to allow the pins to fall onto the chute 12. The pins slide down the chute 12 onto the belt 64 of the pin conveyor PC. The pin conveyor, of course, elevates the pins forwardly and upwardly into an indexing device, not shown, which sends the pins into a storage rack in proper location for lowering onto the lane at the appropriate time.

Difficulty is encountered with the mechanism so far described, after the lanes are conditioned with oil, in that the pin wheel PW and ball wheel BW do not separate the pins from the ball and start the ball on its way along the front and rear guide tracks. Under some conditions, the ball may not rotate and will skid upon the ball elevating wheel BW. Under other conditions, it may rotate over the entry portion of the front guide track. When this occurs, an attendant must be sent to the back of the appropriate lane where the ball has failed to return, and either pick the ball up and put it on the ball-return chute, or else wedge the ball underneath the front guide track to thereby produce the necessary friction to start the ball in its returned path. In any event when the ball stays in the center of the flow path against the rear guide track, the pins may become jammed up behind the ball so that they too help prevent the ball from being conveyed away by the ball elevating wheel BW.

According to the present invention a striker means is provided which will periodically pass through the common flow path, but which for the most part will remain free and clear thereof, so as to not impede the flow of pins to the pin elevating wheel. At the same time, the striker passes through the flow path at such a frequency that it will move a bowling ball out of the common flow path before pins become lodged against the ball to prevent its entry to the guide tracks. In any machine, the pin elevating wheel will usually rotate at a speed sufficient to prevent the pins from jamming up thereon, and applicant has determined that if the striker mechanism is driven in timed relation to the pin elevating wheel, the striker mechanism will substantially in all cases remove the ball before a jamming action occurs. At the same time, the striker means will not be in the common flow path sufficiently long as to itself produce a jam of the pins and ball.

The preferred embodiment of the present invention comprises a striker bar 70 made of plastic and which moves through the common flow path generally at right angles thereto at frequent intervals and preferably in timed relation to the pin elevating wheel. While it may not be necessary in all instances, in the preferred embodiment the striker bar moves downwardly and rearwardly at a slight angle as it approaches the common path, to in this manner drive the ball into contact with the rear guide track as the ball approaches the leading edge of the front guide track. Such motion is conveniently accomplished by rotating the striker bar about a stub axis 71 which slopes downwardly and forwardly at a slight angle relative to the longitudinal centerline of the wheels--which angle is preferably in the range of from approximately 5 to 15 degress. In the embodiment shown in the drawings, the striker bar 70 is supported for rotation about the stub axis 72 by a pulley 74. The pulley 74 has a bearing therein which is journaled on a short stub shaft 76 that is fixed to an angle bracket 78. In the embodiment shown, the angle bracket 78 has both vertical and horizontal abutment surfaces 80 and 82 which can be used to mount to either vertical or horizontal surfaces of the frame of the pin setting apparatus. In the embodiment shown, the forward end of the angle bracket 78, is bent downwardly at 10 degrees, and the end of the stub shaft 76 is welded thereto. A slotted hole is provided in the vertical abutment surface 80, and a bolt extends through the slotted opening and through the horizontal frame member 84 of the machine. The striker bar 70 is fixed to the pulley 74 by spacer bolts 86 and 88 of unequal length, and which are so positioned that the striker bar will be substantially vertical when the bar is in its straight up and down position. The striker bar 70 moves in an inclined path by reason of the angle of the stub shaft 72, as shown in the dot dash line 90, shown in FIG. 4. The pulley 74 is driven in timed relation to the pin elevating wheel PW by means of a belt 92 which extends around the pulley 74 and over the hub 60 of the pin conveyor 64 which, of course, is driven in timed relation to the pin wheel PW. It will be seen from FIG. 4, that the arcuate path 90 of the striker bar forms an outline of a cone having its apex on the stub shaft axis 72. The arcuate path 90 of the striker bar moves downwardly and rearwardly as it approaches its vertical position to strike the ball and then moves upwardly and forwardly. The impact of the striker bar with the ball almost always imparts sufficient velocity to the ball to cause the ball to become wedged under the front guide track FGT. If for some reason the ball does not have sufficient velocity to become wedged under the front guide track FGT, the striker bar will move forwardly and upwardly over the front surface of the ball to keep it in position, until the next revolution of the striker bar. Usually however, only one strike of the striker bar 70 is required to assure entry beneath the front guide track FGT to thereby start the ball on its way around the ball wheel.

It can now be seen that the objects of the present invention have been achieved and that there has been provided a means for positively and selectively removing the ball from the common flow path without interferring with the flow of pins through their common flow path to the pin elevating wheel. To aid in this respect, the means is preferably driven in timed relation to the rotation of the pin elevating wheel but more importantly, however, the means should have a movement which imparts a slight component rearwardly as the means engages the ball, and then moves upwardly and forwardly as it leaves the area of impact. Preferably the striker means should impart sufficient velocity to the ball to raise the leading end of the front guide track. In addition, the striker bar is preferably made of a substantial plastic which will permit bending of the bar over the front face of the ball, if for some reason the ball is not driven clear of the common flow path.

While the invention has been described in considerable detail, I do not wish to be limited to the particular embodiments shown and described; and it is my intention to cover hereby all novel adaptations, modifications, and arrangements thereof which come within the practice of those skilled in the art to which the invention relates and which fall within the purview of the following claims.

I claim:

1. Automatic bowling pin and bowling ball handling apparatus for separating horizontal bowling pins from a flow path that includes a bowling ball, for elevating the ball to an overhead runway, and for elevating the pins to an overhead storage rack, said apparatus comprising: a rear frame structure; an annular bowling pin elevating wheel forwardly of said rear frame structure, said pin elevating wheel having pocket means therein for elevating the pins until they are near to the top of the wheel; an annular bowling ball elevating wheel forwardly of said pin wheel, said ball wheel having a generally horizontal axis of rotation surrounded by an annular internal friction surface for driving a bowling ball upwardly around said ball wheel; a pair of vertically disposed ball guide track members having lower ends mounted radially inwardly of said annular internal friction surface for receiving and guiding a ball from a position on the bottom of said wheel to said overhead runway, said track members being yieldably spaced from said annular friction surface a distance slightly less than the diameter of a bowling ball, one of said track members being disposed forwardly of the centerline of said annular friction surface and the other being disposed rearwardly thereof, the forwardly disposed track member having its lower horizontal end movably mounted for raising movement so that a ball on said annular friction surface of said ball wheel must cause raising thereof to gain entry between the track members; a pin conveyor having a driving pulley at an intermediate level of said pin elevating wheel and with said pin conveyor extending forwardly from said ball wheel to the overhead storage rack; a forwardly and rearwardly extending stub shaft having a longitudinally extending axis inside said wheels at a level beneath said driving pulley of said pin conveyor; said stub shaft axis extending forwardly and downwardly at a predetermined angle to said axis of rotation of said ball wheel; a striker bar; means supporting said striker bar for rotation about said stub shaft axis with a supported end adjacent said stub shaft and a projecting end clearing said annular friction surface by less than the diameter of a bowling ball; and means rotatably driving said striker bar in the same direction as said ball wheel; and whereby said striker bar rotates with a slight rearward component when moving downwardly into said flow path and a slight forward component when moving upwardly out of said flow path.

2. The apparatus of claim 1 comprising: a drive belt receiving surface on said driving pulley of said pin conveyor; said means supporting said striker bar comprising a belt pulley journaled for rotation about said stub shaft axis with said striker bar being supported from said belt pulley at an angle wherein the locus of rotation of said projecting end of said striker bar is axially forward of its supported end; and said means driving said striker bar comprising a drive belt connecting said belt pulley and said drive belt receiving surface on said driving pulley of said pin conveyor.

3. The apparatus of claim 2 wherein said striker bar is supported from said belt pulley by fasteners of different lengths which offset said striker bar from a normal to said stub shaft axis at approximately the same angle as said stub shaft axis at approximately the same angle as said stub shaft axis is positioned relative to the horizontal centerline of the annular bowling wheel.

4. In an automatic pin and bowling ball handling apparatus of the type having an elevated storage rack for pins, an elevated ball return runway, a rear frame, an annular bowling pin elevating wheel forwardly of said rear frame structure, an annular bowling ball elevating wheel forwardly of said pin wheel, said ball wheel having a generally horizontal centerline and an annular internal friction surface extending around said centerline for driving a bowling ball upwardly around said ball wheel; and guide track means starting adjacent the bottom of said ball wheel and extending around and upwardly of said ball wheel, said guide track means functioning to bias a bowling ball against the internal friction surface of said ball wheel and which must be raised slightly by a ball for entry thereto, the improvement comprising: a stub shaft having a longitudinally extending axis which extends forwardly and downwardly at a predetermined angle relative to the centerline of said ball wheel; a driven belt pulley rotatable about said stub shaft axis; a striker bar having inner and projecting ends, said inner end being secured to said driven belt pulley at an angle such that the locus of rotation of the projecting end of said striker bar is axially forwardly of its inner end; and means for rotating said drive belt pulley when said ball wheel is operated.

5. The device of claim 4 wherein said striker bar is positioned at an angle relative to a normal to said stub shaft axis which at least approximately equals the angle of said stub shaft axis to the horizontal centerline of said ball wheel.

6. A striker bar for bowling balls, comprising:

a bracket having an abutment surface for fastening to the frame of an automatic pin setting machine, a stub shaft having a centerline extending forwardly and downwardly at an angle relative to said abutment surface, a drive pulley constructed and arranged for rotation in a plane that is perpendicular to said stub shaft centerline, a plastic striker bar having inner and projecting ends and the inner end of which is secured to said drive pulley at an angle wherein the locus of rotation of the projecting end of said striker bar is positioned axially forwardly of its inner end, and whereby rotation of said drive pulley rotates said striker bar in a generally conical path.

7. The striker bar of claim 6 wherein said striker bar is secured to said drive pulley at approximately the same angle as said stub shaft centerline is positioned to a normal to said abutment surface.

* * * * *